US010673150B2

(12) United States Patent
Nabeta et al.

(10) Patent No.: US 10,673,150 B2
(45) Date of Patent: Jun. 2, 2020

(54) TERMINAL-BONDED CABLE

(71) Applicant: Yazaki Corporation, Tokyo (JP)

(72) Inventors: Yasunori Nabeta, Shizuoka (JP); Naoki Ito, Shizuoka (JP); Tomoya Sato, Shizuoka (JP)

(73) Assignee: YAZAKI CORPORATION, Minato-ku, Tokyo (JP)

( * ) Notice: Subject to any disclaimer, the term of this patent is extended or adjusted under 35 U.S.C. 154(b) by 0 days.

(21) Appl. No.: 16/274,746

(22) Filed: Feb. 13, 2019

(65) Prior Publication Data

US 2019/0260140 A1 Aug. 22, 2019

(30) Foreign Application Priority Data

Feb. 19, 2018 (JP) ..... 2018-026771

(51) Int. Cl.
*H01R 4/10* (2006.01)
*H01R 4/02* (2006.01)

(52) U.S. Cl.
CPC ..... *H01R 4/023* (2013.01); *H01R 4/029* (2013.01)

(58) Field of Classification Search
CPC ..... H01R 4/20; H01R 13/112; H01R 4/185; H01R 4/2466; H01R 13/04; H01R 23/025
USPC ..... 439/880, 857, 877, 397, 884, 418
See application file for complete search history.

(56) References Cited

U.S. PATENT DOCUMENTS

| | | | | |
|---|---|---|---|---|
| 4,142,771 | A | 3/1979 | Barnes et al. | |
| 8,245,396 | B2 * | 8/2012 | Kondo | H01R 4/185 174/84 R |
| 10,276,283 | B2 * | 4/2019 | Nabeta | H01B 5/08 |

FOREIGN PATENT DOCUMENTS

| | | | |
|---|---|---|---|
| CN | 201584506 | U | 9/2010 |
| JP | 2005-340107 | A | 12/2005 |
| JP | 2009-277445 | A | 11/2009 |
| JP | 2013196880 | A | 9/2013 |
| JP | 2014107104 | A | 6/2014 |
| JP | 2015-135742 | A | 7/2015 |
| JP | 2015153604 | A | 8/2015 |
| JP | 2016001542 | A | 1/2016 |
| WO | 2008/152000 | A1 | 12/2008 |
| WO | 2011/155115 | A1 | 12/2011 |

* cited by examiner

*Primary Examiner* — Phuong Chi Thi Nguyen
(74) *Attorney, Agent, or Firm* — Sughrue Mion, PLLC

(57) ABSTRACT

A terminal-bonded cable includes a terminal including: a conductor-bonded portion and a sheath-contacted portion; and a cable including a conductor constituted by a plurality of strands, a sheath which covers the conductor, an exposed conductor portion in which the conductor is partially exposed from the sheath in the length direction, and a bond portion which is formed in a part of the exposed conductor portion and in which strands are bonded to each other. The bond portion is bonded to the conductor-bonded portion. The sheath is in contact with the sheath-contacted portion. The conductor-bonded portion protrudes in a thickness direction from the sheath-contacted portion.

5 Claims, 10 Drawing Sheets

TERMINAL-BONDED CABLE

CROSS REFERENCE TO RELATED APPLICATION

The present application is based on, and claims priority from Japanese Patent Application No. 2018-026771, filed Feb. 19, 2018, the disclosure of which is hereby incorporated by reference herein in its entirety.

TECHNICAL FIELD

The present application relates to a terminal-bonded cable, and in particular, to one in which an exposed conductor (a conductor composed of a plurality of strands) of a cable is bonded to a terminal.

BACKGROUND ART

A conventional terminal-bonded cable 301 as illustrated in FIGS. 19 and 20 is known (see JP 2015-135742 A). The conventional terminal-bonded cable 301 includes a cable 303 and a terminal 305.

The cable 303 includes a conductor 309 composed of a plurality of strands 307 and a sheath 311 covering the conductor 309 so that the conductor 309 is exposed over a predetermined length.

In the conventional terminal-bonded cable 301, a part of the conductor 309 not covered with the sheath 311 and a part of the terminal 305 are put between an anvil 313 and a horn 315, and the horn 315 is ultrasonically vibrated so that the bonding (ultrasonic bonding) of the conductor 309 of the cable 303 to the terminal 305 is performed.

A bond portion 317 in which the strands 307 are bonded to each other is formed at a portion where the conductor 309 is bonded to the terminal 305.

SUMMARY

In the conventional terminal-bonded cable 301, the conductor 309 (bond portion 317) is bonded to a planar portion of the terminal 305 and the sheath 311 of the cable 303 is in contact with the planar portion at the same time.

As a result, in an intermediate portion 319 positioned between the bond portion 317 and the portion covered with the sheath 311, the strands 307 positioned on a side of the horn 315 (upper side in FIG. 20) are particularly largely deformed.

Then, the strands 307 may occasionally be cut due to pressurization (pinching by the anvil 313 and the horn 315) and vibration by the horn 315 at the time of ultrasonic bonding. In FIG. 20, what is indicated by reference numeral 307A is a strand that has been cut.

In the conventional terminal-bonded cable 301, since the conductor 309 (the bond portion 317) is bonded to the planar portion of the terminal 305, there is a possibility that the bond portion 317 is peeled off from the terminal 305 when a force or moment for peeling the bond portion 317 from the terminal 305 is applied.

The above problems also occur when the conductor of the cable is bonded to the terminal by a bonding method other than ultrasonic bonding.

The present application has been made in consideration of the above-mentioned problems, and an object is to prevent a strand constituting a conductor from being cut in a terminal-bonded cable in which the conductor of a cable is bonded to a terminal.

A terminal-bonded cable according to an aspect of the present application includes: a terminal including a conductor-bonded portion and a sheath-contacted portion; and a cable including a conductor constituted by a plurality of strands, a sheath that covers the conductor, an exposed conductor portion in which a part of the conductor is exposed in a length direction, and a bond portion which is formed in a part of the exposed conductor portion and in which the strands are bonded to each other. The bond portion is bonded to the conductor-bonded portion. The sheath is in contact with the sheath-contacted portion. The conductor-bonded portion protrudes in the thickness direction more than the sheath-contacted portion.

Preferably, the conductor-bonded portion and the sheath-contacted portion are constituted by a flat-plate-shaped main body portion and a flat-plate-shaped folded portion, the folded portion is folded back with respect to the main body portion along the boundary between the main body portion and the folded portion so that the folded portion overlaps a part of the main body portion, the conductor-bonded portion is formed in a portion where the main body portion and the folded portion overlap each other, the sheath-contacted portion is formed only in a position of the main body portion where the folded portion does not overlap, the bond portion is bonded to the surface of the folded portion, and the sheath is in contact with the surface of the main body portion.

The bond portion and the conductor-bonded portion may be bonded together with ultrasonic bonding. In this case, a trace caused by contact with the horn used in the ultrasonic bonding or a trace caused by contact with the anvil used in the ultrasonic bonding may be formed on the bond portion.

An anchor portion may be provided at the conductor-bonded portion, and a bond portion may be engaged with the anchor portion.

Preferably, the anchor portion has a recess formed by being recessed from the anchor exclusion portion which is a portion of the conductor-bonded portion excluding the anchor portion and the inner diameter of at least a part of the recess increases with distance from the anchor exclusion portion.

According to the aspect of the present application, the effect of preventing cutting of the strands constituting the conductor is brought about in the terminal-bonded cable in which a conductor of cable is bonded to a terminal.

DESCRIPTION OF EMBODIMENTS

Figure 3:
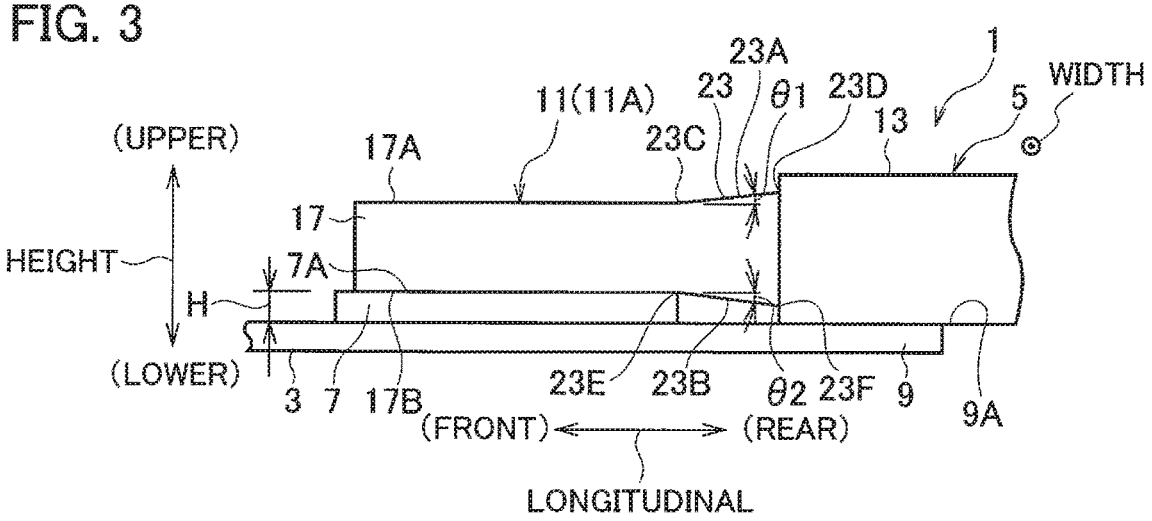
FIG. 3 is a diagram illustrating the terminal-bonded cable according to the embodiment.

As illustrated in FIG. 3, a terminal-bonded cable 1 according to an embodiment includes a terminal 3 and a cable 5.

Here, for convenience of description, it is assumed that a length direction of the terminal-bonded cable 1 (cable 5) is a longitudinal direction, a predetermined direction perpendicular to the longitudinal direction is defined as the height direction, and a direction perpendicular to the longitudinal direction and the height direction is defined as a width direction.

The terminal 3 is made of a metal or the like having conductivity, and includes a conductor-bonded portion 7 and a sheath-contacted portion 9. A conductor 11 of the cable 5 is bonded to the conductor-bonded portion 7. A sheath 13 of the cable 5 is in contact with the sheath-contacted portion 9.

The conductor 11 of the cable 5 includes a plurality of strands 15. The strands 15 of the conductor 11 are formed in an elongated columnar shape and made of a metal such as copper, aluminum, aluminum alloy, or the like. The conductor 11 is configured in a form in which the plurality of strands 15 are twisted or in a form in which the plurality of strands 15 collectively extend in a straight line.

The cable 5 has flexibility. The cross section (a cross section along a plane perpendicular to the length direction) of a portion of the cable 5 where the sheath 13 is present is formed in a predetermined shape such as a circular shape.

The cross section of the conductor 11 at the portion of the cable 5 where the sheath 13 is present is formed in a substantially circular shape because the plurality of strands 15 are bundled with almost no gaps. The cross section of the sheath 13 at the portion of the cable 5 where the sheath 13 is present is formed in an annular shape having a predetermined thickness. The entire of the inner circumference of the sheath 13 is in contact with the entire of the outer circumference of the conductor 11.

In the embodiment, for convenience of description, it is assumed that the cable 5 having flexibility extends straight in the longitudinal direction.

The sheath 13 of the cable 5 covers the conductor 11 so that the conductor 11 is exposed partially (for example, a front end) in the length direction.

Then, a bond portion (conductor bond portion) 17 in which the strands 15 are bonded to each other is formed on an exposed conductor portion 11A which is an exposed conductor at a portion separated from the sheath 13 by a predetermined distance in the longitudinal direction. In the conductor bond portion 17, the conductor 11 is made into a single line, for example.

The conductor bond portion 17 is bonded to the conductor-bonded portion 7 and the front end of the sheath 13 on a side of the exposed conductor portion 11A is in contact with the sheath-contacted portion 9.

Figure 1:
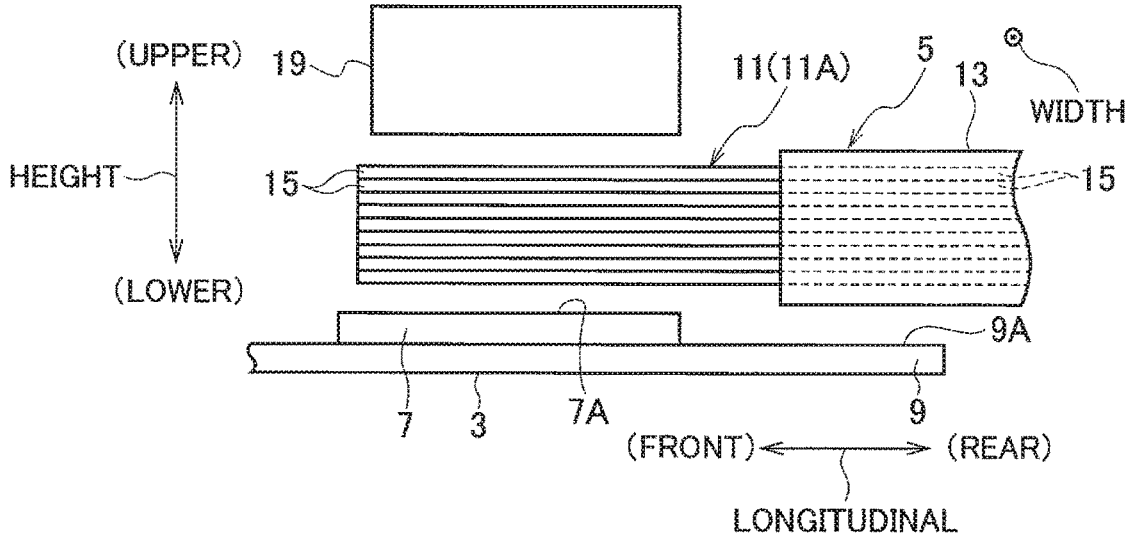
FIG. 1 is a diagram illustrating a method of manufacturing a terminal-bonded cable according to an embodiment, and illustrates a state before forming a bond portion.
Figure 2:
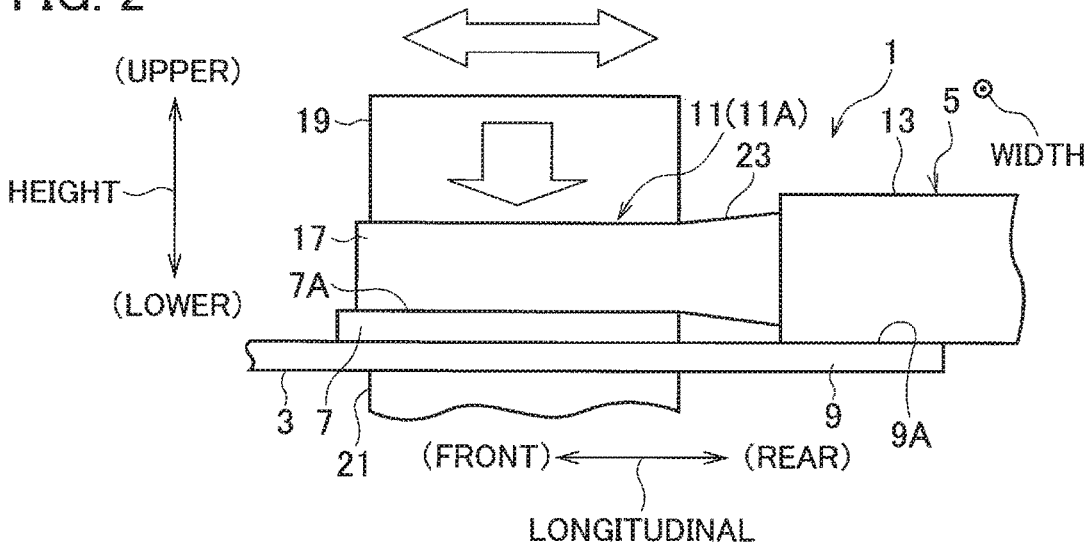
FIG. 2 is a diagram illustrating the method of manufacturing the terminal-bonded cable according to the embodiment, and illustrates a state when the bond portion is formed.

As illustrated in FIGS. 1 and 2, the formation of the conductor bond portion 17 and the bonding of the conductor bond portion 17 to the conductor-bonded portion 7 are performed in one step by ultrasonic bonding using a horn 19 and an anvil 21, for example.

More specifically, as illustrated in FIG. 2, while the front ends of respective strands 15 (exposed conductor portion 11A) of the conductor 11 and the conductor-bonded portion 7 of the terminal 3 are put between the horn 19 and the anvil 21, the horn 19 in contact with the conductor 11 is ultrasonically vibrated in the longitudinal direction for example, thereby forming the conductor bond portion 17 and bonding the conductor bond portion 17 to the conductor-bonded portion 7.

In the terminal-bonded cable 1 according to the embodiment, the conductor-bonded portion 7 protrudes from the sheath-contacted portion 9 by a predetermined height H in the height direction from a portion of the sheath 13 in contact with the sheath-contacted portion 9 toward the conductor 11 (upper side) as illustrated in FIG. 3.

The protrusion of the conductor-bonded portion 7 is provided in order to reduce the internal stress generated in the strands 15 of the conductor 11 at an intermediate portion 23 formed between the conductor bond portion 17 and the sheath 13 in the longitudinal direction. Incidentally, the strands 15 are not bonded to each other in the intermediate portion 23 and the portion of the conductor 11 covered with the sheath 13.

In addition, the conductor bond portion 17 is formed in, for example, a rectangular parallelepiped (quadrangular prism shape), and the dimension in the width direction is larger than the dimension in the height direction. Also, when viewed in the longitudinal direction, the portion of the conductor 11 covered with the sheath 13 has a circular shape.

The cross-sectional shape of the conductor bond portion 17 along a plane perpendicular to the longitudinal direction is smaller than the cross-sectional shape of the portion of the conductor 11 covered with the sheath 13. The cross-sectional shape of the intermediate portion 23 gradually changes from the circular shape of the portion covered with the sheath 13 to the rectangular shape of the conductor bond portion 17.

When viewed in the longitudinal direction, the rectangular conductor bond portion 17 is positioned inside the circular conductor 11 covered with the sheath 13, and the center of the conductor 11 covered with the sheath 13 and the center of the conductor bond portion 17 agree with each other, for example. Incidentally, the center of the conductor 11 covered with the sheath 13 may deviate from the center of the conductor bond portion 17.

The value of the predetermined height H is, for example, a value so that an angle θ1 and an angle θ2 illustrated in FIG. 3 are equal to each other. The angle θ1 is an intersection angle of an upper surface 23A of the intermediate portion 23 with respect to a straight line (for example, an upper surface 17A of the bond portion 17) extending in the longitudinal direction, and the angle θ2 is an intersection angle of a lower surface 23B of the intermediate portion 23 with respect to a straight line (for example, a lower surface 17B of the bond portion 17) extending in the longitudinal direction.

Here, the intersection angle will be described. In general, there are two intersection angles as the angle of intersection of two straight lines on a plane. The sum of these two intersection angles is 180 degrees. One angle of the two intersection angles is an acute angle and the other intersection angle is an obtuse angle. The intersection angles θ1 and 02 in the present specification are the smaller one (acute angle) of the two intersection angles as already understood.

The value of the predetermined height H (the value of each of the intersection angles θ1 and 02) may be appropriately changed. That is, in FIG. 3, the intersection angle θ1 may be changed within the range in which the position of a front end 23C of the upper surface 23A of the intermediate portion 23 is located lower than the position of a rear end 23D of the upper surface 23A of the intermediate portion 23 in the height direction, and the intersection angle θ2 may be changed within the range in which the position of a front end 23E of the lower surface 23B of the intermediate portion 23 is higher than the position of a rear end 23F of the lower surface 23B of the intermediate portion 23 in the height direction.

The terminal-bonded cable 1 according to the embodiment will be described in more detail.

Figure 4C:
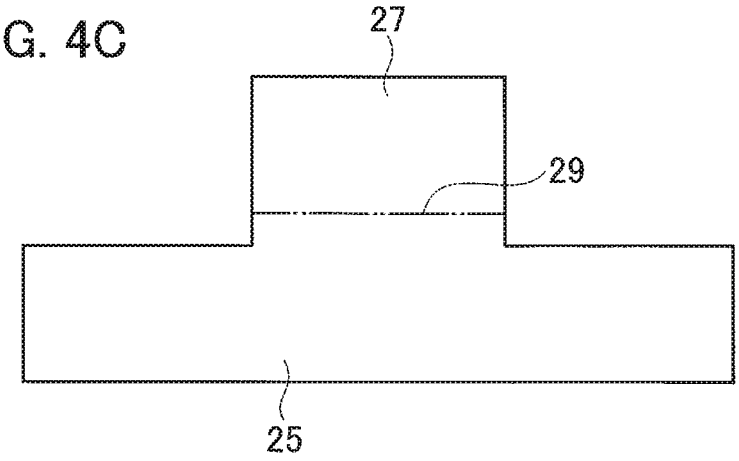
FIG. 4C is a development view of the terminal.
Figure 4B:
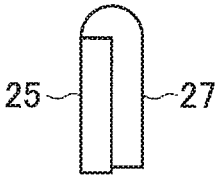
FIG. 4B is a side view of the terminal.
Figure 4A:
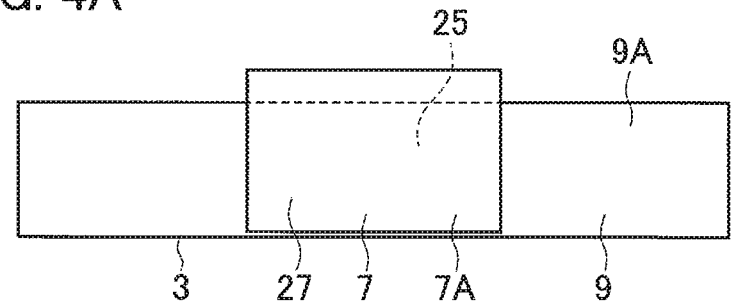
FIG. 4A is a front view of the terminal of the terminal-bonded cable according to the embodiment.

The conductor-bonded portion 7 and the sheath-contacted portion 9 of the terminal 3 are constituted by a flat-plate-shaped main body portion 25 and a flat-plate-shaped folded portion 27 as illustrated in FIGS. 4A to 4C. When viewed in the thickness direction of the main body portion 25 and the folded portion 27, the main body portion 25 and the folded portion 27 are each formed in a rectangular shape, and the folded portion 27 is smaller than the main body portion 25.

In the terminal 3, the folded portion 27 is folded back at an angle of 180 degrees with respect to the main body portion 25 along a linear boundary 29 extending in the longitudinal direction between the main body portion 25 and the folded portion 27, so that the folded portion 27 overlaps a part of the main body portion 25 so as to be in surface contact with the main body portion 25.

The conductor-bonded portion 7 is formed in a position where the main body portion 25 and the folded portion 27 overlap each other. Further, the sheath-contacted portion 9 is formed only in a position of the main body portion 25 where the folded portion 27 does not overlap the main body portion 25. The value of the thickness of the conductor-bonded portion 7 is twice the value of the thickness of the sheath-contacted portion 9.

Figure 5:
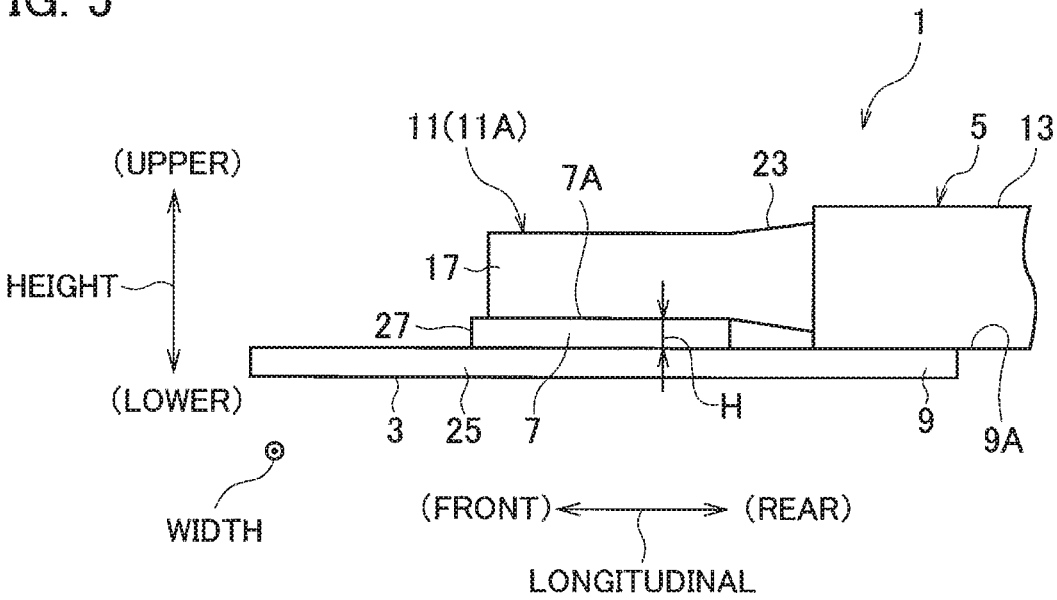
FIG. 5 is a diagram illustrating a terminal-bonded cable with the terminal illustrated in FIGS. 4A to 4C.

As illustrated in FIG. 5, the conductor bond portion 17 of the cable 5 is bonded to an upper surface 7A of the conductor-bonded portion 7. In addition, the sheath 13 of the cable 5 is in contact with an upper surface 9A of the sheath-contacted portion 9.

The terminal 3 illustrated in FIGS. 4A to 4C and the terminal-bonded cable 1 illustrated in FIG. 5 will be further described. As illustrated in FIG. 4A, in the conductor-bonded portion 7 of the terminal 3, the folded portion 27 overlaps substantially the entire intermediate portion in the longitudinal direction which is a part of the rectangular main body portion 25.

In consequence, the conductor-bonded portion 7 is formed at the intermediate portion in the longitudinal direction of the terminal 3, and the sheath-contacted portion 9 is formed at the rear end of the terminal 3 in the longitudinal direction. The protrusion height dimension H of the conductor-bonded portion 7 from the sheath-contacted portion 9 is equal to the thickness of the folded portion 27.

In the longitudinal direction, the sheath 13 of the cable 5 is separated from the folded portion 27 by a predetermined distance, and the intermediate portion 23 of the cable 5 is positioned between the folded portion 27 and the sheath 13.

On the conductor bond portion 17 of the terminal-bonded cable 1, a trace caused by contact with the horn 19 used in ultrasonic bonding is formed. For example, at least a part of irregularities formed at the portion of the horn 19 in contact with the conductor bond portion 17 during ultrasonic bonding is transferred to the upper surface of the conductor bond portion 17.

In addition, on the lower surface of the main body portion 25, a trace caused by contact with the anvil 21 used for ultrasonic bonding may be formed in some cases. For example, at least a part of the irregularities formed at the portion of the anvil 21 in contact with the main body portion 25 during ultrasonic bonding may be transferred to the lower surface of the main body portion 25.

Incidentally, a trace caused by contact with the anvil 21 used for ultrasonic bonding may be formed on the conductor bond portion 17. In addition, a trace caused by contact with the horn 19 used for ultrasonic bonding may be formed on the back surface of the main body portion 25.

Next, the terminal-bonded cable 1 in which the terminal according to each modification is used will be described with reference to FIGS. 6A to 11.

A terminal 3 according to a first modification illustrated in FIGS. 6A to 6C and 7 differs from the terminal 3 according to the embodiment illustrated in FIGS. 4A to 4C and 5 in that a plurality (two for example) of rectangular folded portions 27 are provided, and a plurality (two for example) of boundaries 29 between the main body portion 25 and each of the folded portions 27 are formed, and then a conductor-bonded portion 7 is formed by folding back each of the folded portions 27 at a 180-degree angle along each boundary 29.

Figure 6C:
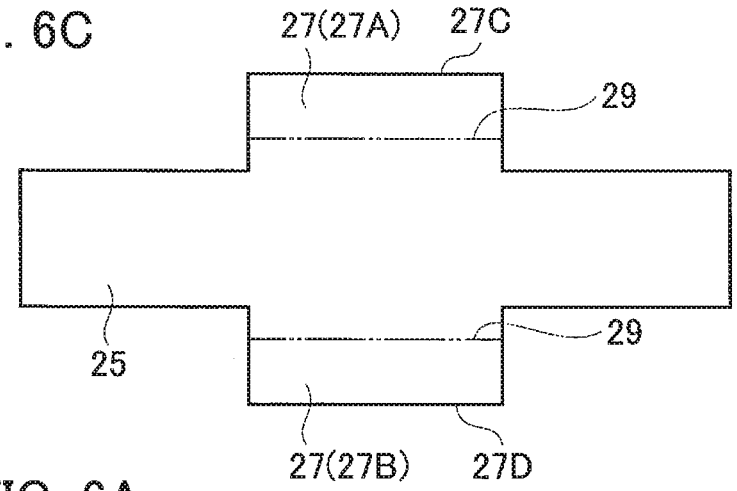
FIG. 6C is a development view of the terminal.
Figure 6B:
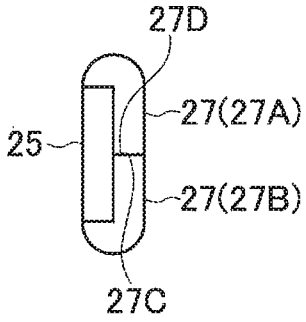
FIG. 6B is a side view of the terminal.
Figure 6A:
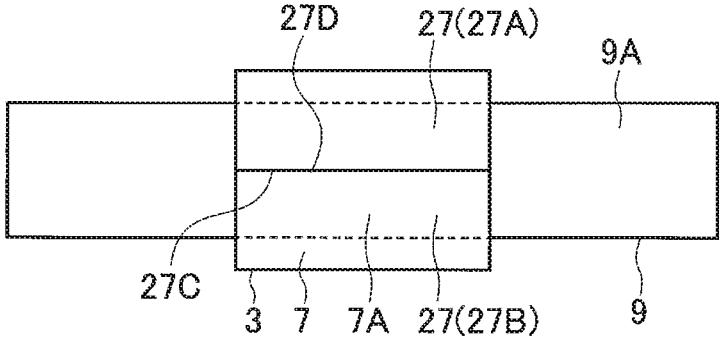
FIG. 6A is a front view illustrating a terminal according to a first modification of the terminal-bonded cable according to the embodiment.
Figure 7:
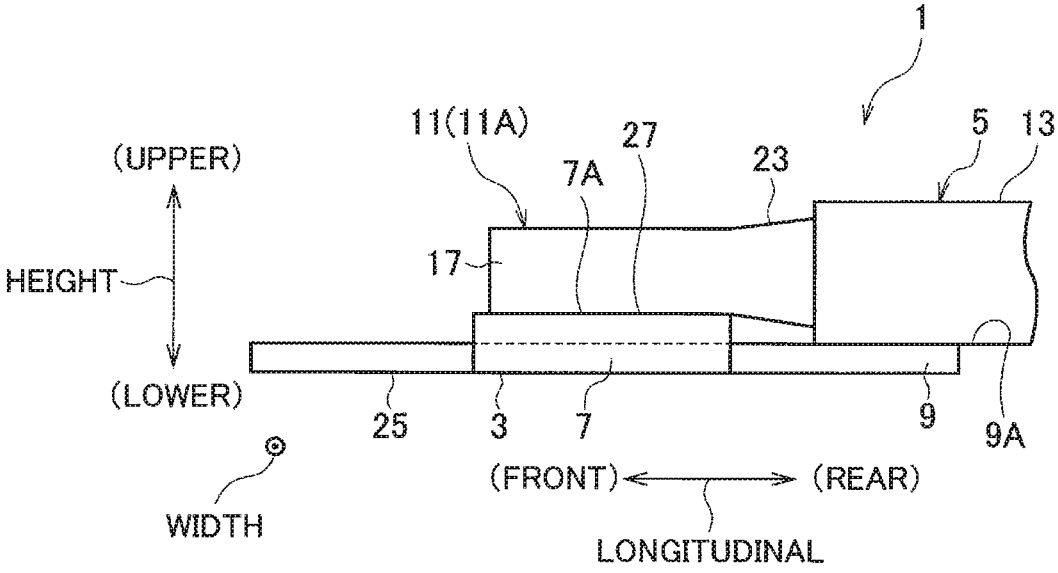
FIG. 7 is a diagram illustrating a terminal-bonded cable provided with the terminal according to the first modification illustrated in FIGS. 6A to 6C.

In the conductor-bonded portion 7 of the terminal 3 according to the first modification illustrated in FIGS. 6A to 6C and 7, an end 27C of a rectangular first folded portion 27A and an end 27D of a rectangular second folded portion 27B are in contact with each other or are slightly separated from each other. Although the first folded portion 27A and the second folded portion 27B illustrated in FIGS. 6C and 6A are formed to have the same shape, they may have different sizes from each other.

A terminal 3 according to a second modification illustrated in FIGS. 8A to 8C and 9 are different from the terminal 3 according to the first modification illustrated in FIGS. 6A to 6C and 7 in that the shapes of a first folded portion 27A and a second folded portion 27B are formed in a trapezoidal shape in which one of the oblique sides is perpendicular to the upper base and the lower base.

Figure 8C:
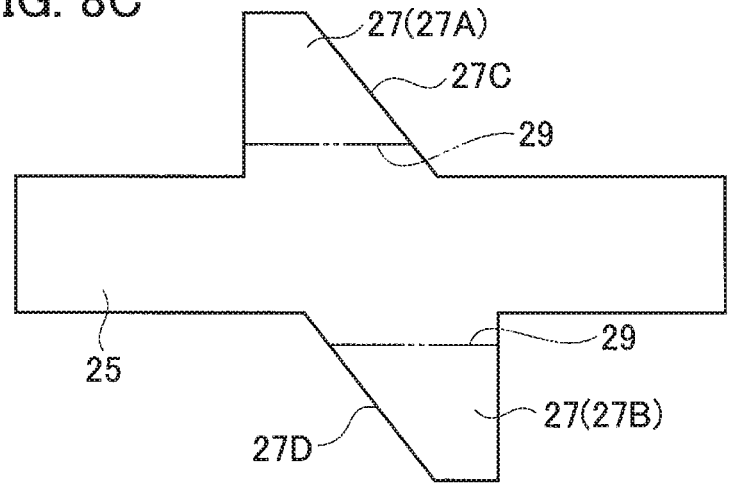
FIG. 8C is a development view of the terminal.
Figure 8B:
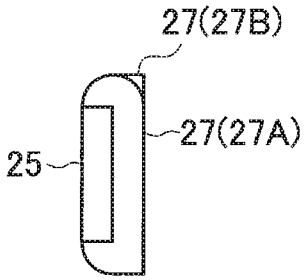
FIG. 8B is a side view of the terminal.
Figure 8A:
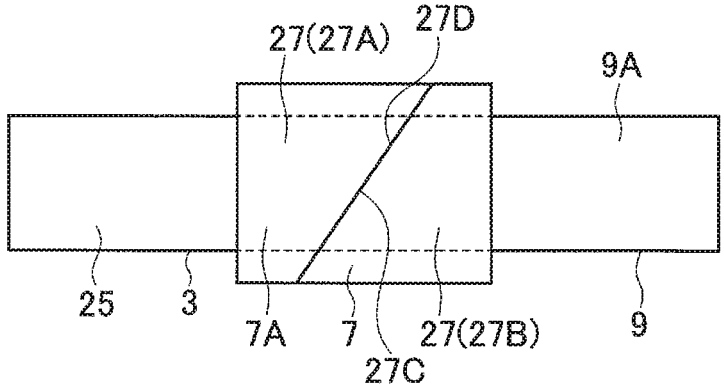
FIG. 8A is a diagram illustrating a terminal according to a second modification of the terminal-bonded cable according to the embodiment.
Figure 9:
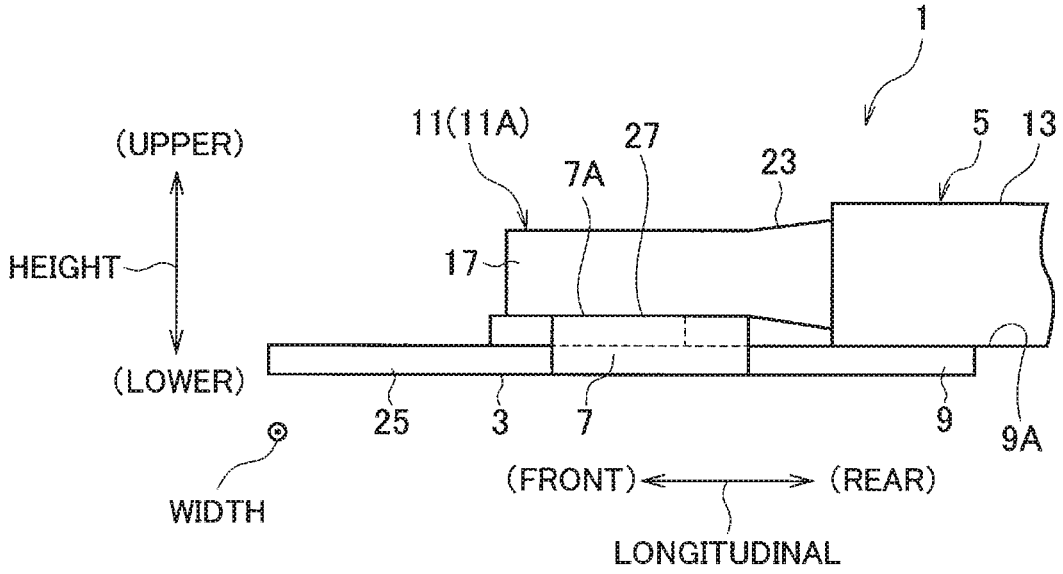
FIG. 9 is a diagram illustrating a terminal-bonded cable provided with the terminal according to the second modification illustrated in FIGS. 8A to 8C.
Figure 10C:
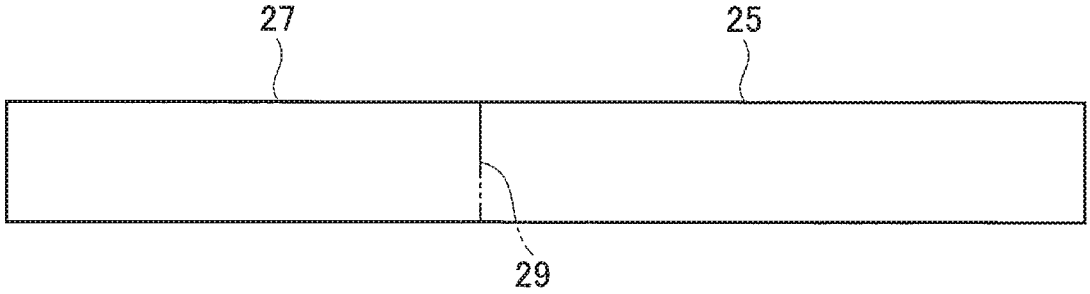
FIG. 10C is a development view of the terminal.
Figure 10A:
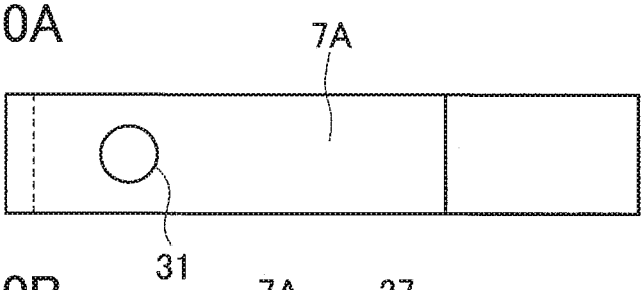
FIG. 10A is a front view illustrating a terminal according to a third modification of the terminal-bonded cable according to the embodiment.
Figure 10B:
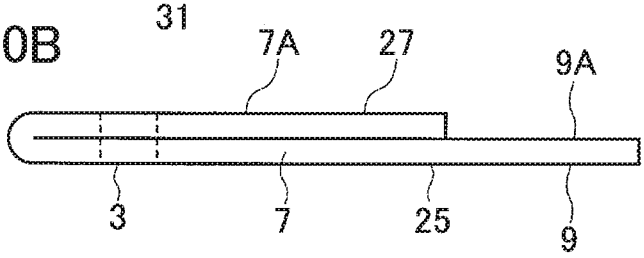
FIG. 10B is a side view of the terminal.
Figure 11:
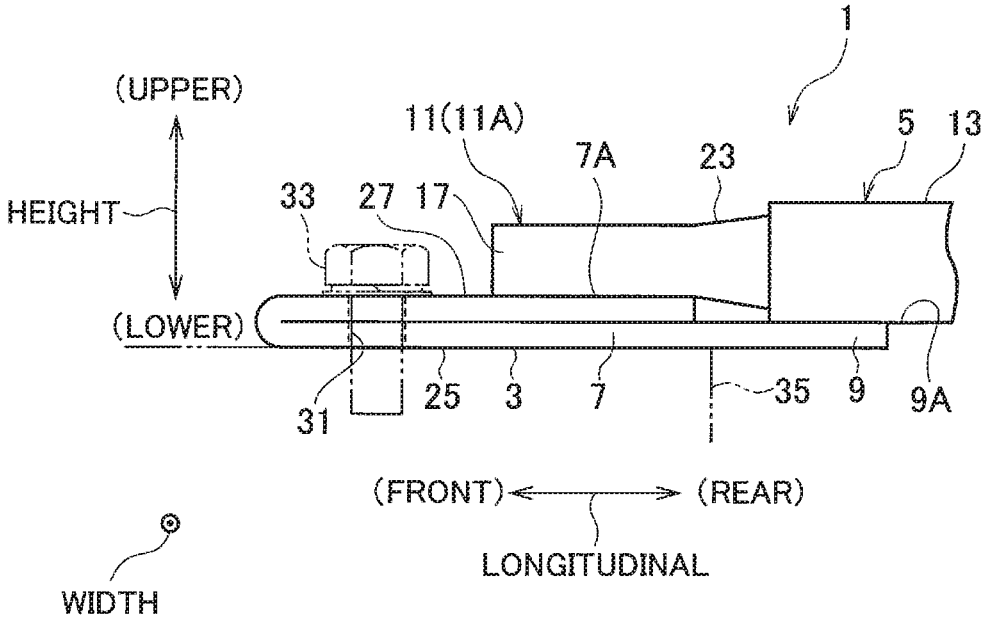
FIG. 11 is a diagram illustrating a terminal-bonded cable provided with the terminal according to the third modification illustrated in FIGS. 10A to 10C.
Figure 12C:
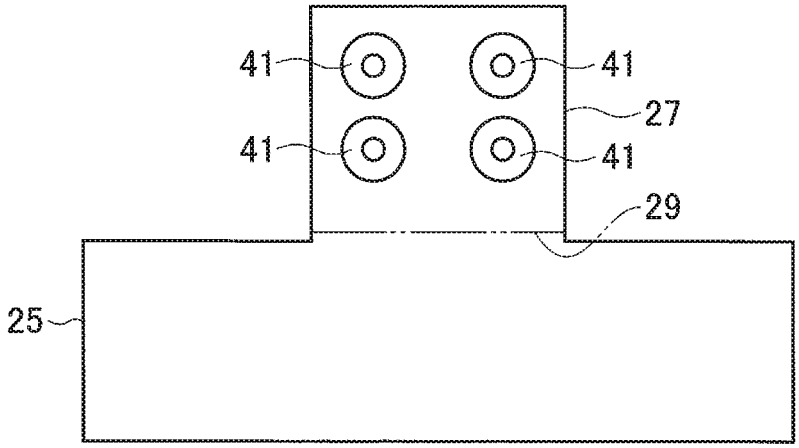
FIG. 12C is a development view of the terminal.
Figure 12B:
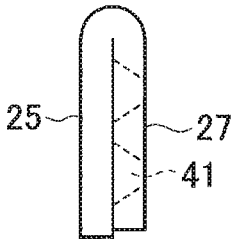
FIG. 12B is a side view of the terminal.
Figure 12A:
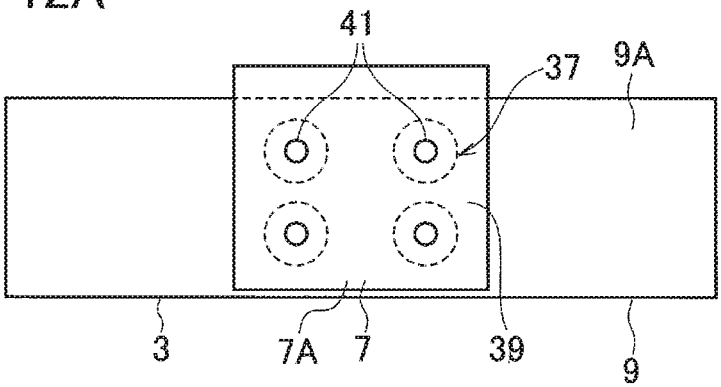
FIG. 12A is a front view illustrating a terminal according to a fourth modification of the terminal-bonded cable according to the embodiment.
Figure 13:
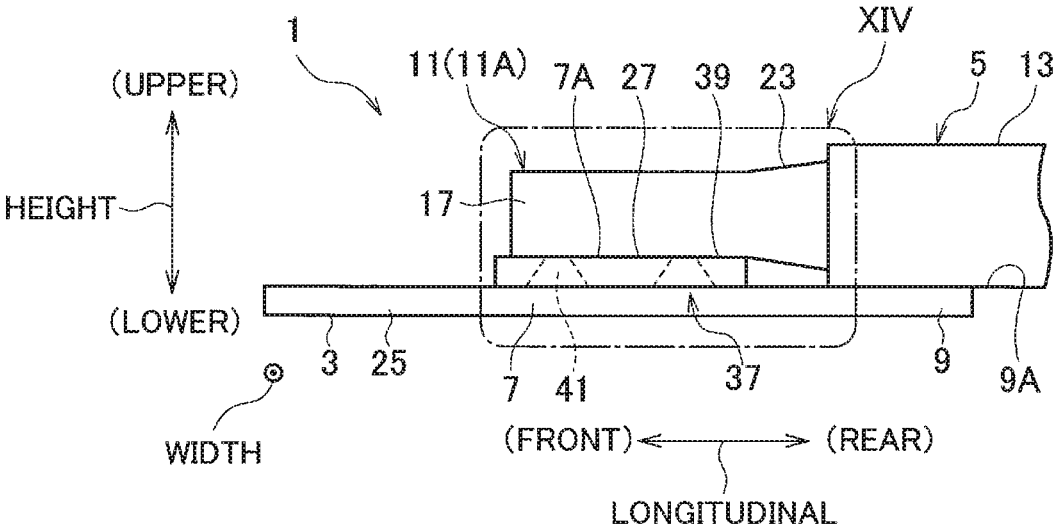
FIG. 13 is a diagram illustrating a terminal-bonded cable provided with the terminal according to the fourth modification illustrated in FIGS. 12A to 12C.

In a conductor-bonded portion 7 of the terminal 3 according to the second modification illustrated in FIGS. 8A to 8C and 9, one trapezoidal oblique side 27C of the trapezoidal first folded portion 27A and one trapezoidal oblique side 27D of the trapezoidal second folded portion 27B are in contact with each other or slightly apart from each other. Although the first folded portion 27A and the second folded portion 27B illustrated in FIG. 8C and FIG. 8A are formed in the same shape, they may be different in size and shape from each other.

A terminal 3 according to a third modification illustrated in FIGS. 10A to 10C and 11 is different from the terminal 3 according to the embodiment illustrated in FIGS. 4A to 4C and 5 in that one boundary 29 between a main body portion 25 and a folded portion 27 extends in the width direction and a hole 31 penetrating a conductor-bonded portion 7 is formed on the front side of the conductor-bonded portion 7.

As for a terminal-bonded cable 1 according to the third modification illustrated in FIGS. 10A to 10C and 11, the terminal 3 can be fixed on another member 35 by using a through hole 31 and a bolt 33, for example.

Figure 14:
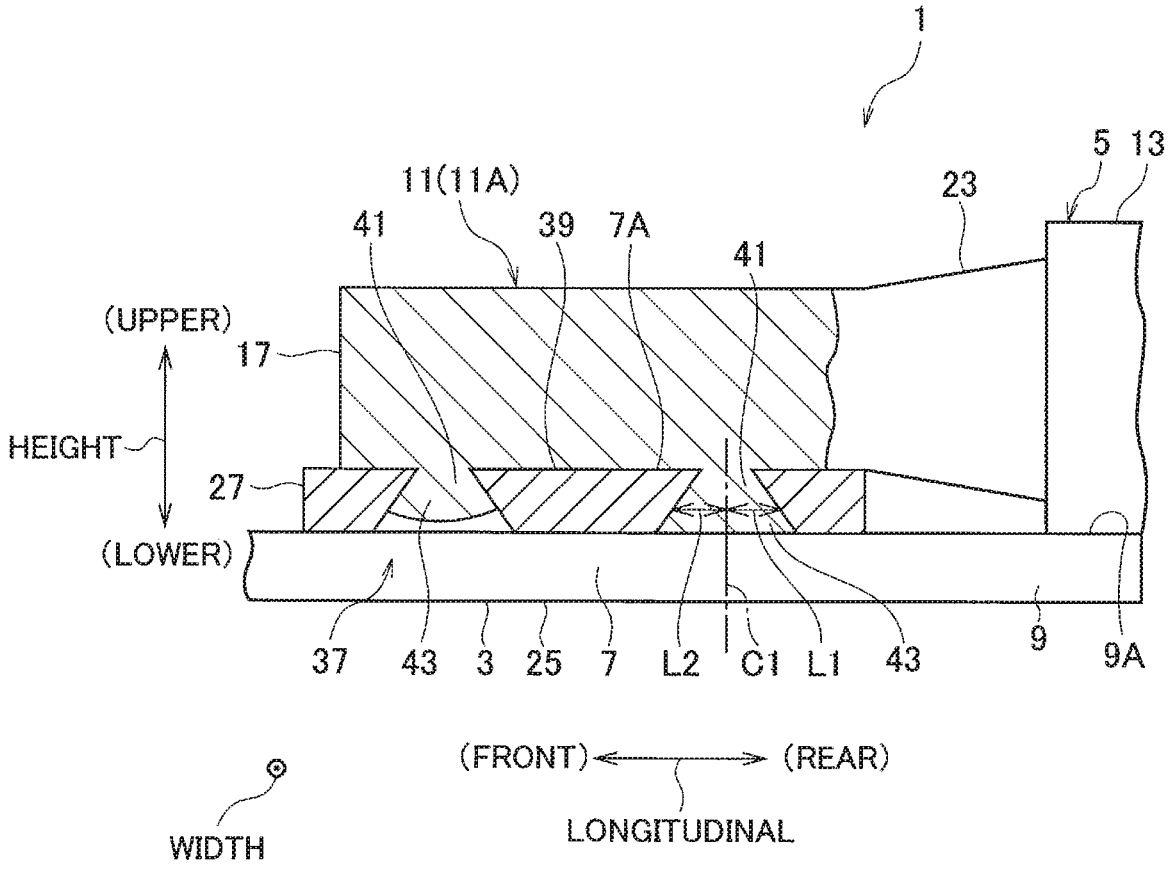
FIG. 14 is an enlarged cross-sectional view of the XIV portion of FIG. 13.

Further, as in a fourth modification illustrated in FIGS. 12A to 14, anchor portions 37 may be provided in a conductor-bonded portion 7. Then, a part of the conductor bond portion 17 may be engaged with the anchor portion 37, as illustrated in FIG. 14.

In the case where the anchor portions 37 are provided, each of the anchor portions 37 is provided by, for example, a recess 41 formed by being recessed from an anchor exclusion portion 39, which is a portion of the conductor-bonded portion 7 excluding the anchor portions 37. The anchor exclusion portion 39 is formed on the planar upper surface 7A of the conductor-bonded portion 7. Each recess 41 is formed by being recessed downward (toward the main body portion 25) from the anchor exclusion portion 39.

In addition, the inner diameter of at least a part of the recess 41 gradually increases with distance from the anchor exclusion portion 39 (from the upper side to the lower side).

More specifically, the lateral dimension value between a pair of portions of the inner wall surface facing each other in the lateral direction in the recess 41 forming each of the anchor portions 37 is small in a shallow portion (upper side) of the recess 41 and is large in a deep portion (lower side) of the recess 41. Here, the lateral direction is an arbitrary direction perpendicular to the depth direction (height direction) of the recess 41 (the development direction of the plane of the anchor exclusion portion 39 formed in a planar shape).

Further, assuming that a straight line passing through a center of the recess 41 and perpendicular to the anchor exclusion portion 39 is a center line of the recess 41, the value of the dimension in the lateral direction between the center line and one portion of the pair of portions is small at a shallow portion of the recess 41 and is large at a deep portion of the recess 41. Furthermore, the value of the dimension in the lateral direction between the center line and the other portion of the pair of portions is also small at a shallow portion of the recess 41 and is large at a deep portion of the recess 41.

More specifically, the recess 41 is formed in a truncated cone shape, and the upper surface of the truncated cone is located at the anchor exclusion portion 39 which is the upper surface of the folded portion 27, and the lower surface of the truncated cone is located at the lower surface of the folded portion 27.

As a result, as illustrated in FIG. 14, the lateral distance L1 between the inner wall of the recess 41 located on one side with respect to the central axis C1 of the recess 41 in the lateral direction and the central axis C1 is small at a shallow portion of the recess 41 and gradually increases toward the deeper portion of the recess 41.

As illustrated in FIG. 14, the lateral distance L2 between the inner wall of the recess 41 located on the other side with respect to the central axis C1 of the recess 41 in the lateral direction and the central axis C1 is also small at a shallow portion of the recess 41 and gradually increases toward the deeper portion of the recess 41.

For example, a plurality of recesses 41 (four in FIGS. 12A to 12C) are formed, and the recesses 41 penetrate the folded portion 27 in the thickness direction, but are not formed in the main body portion 25.

That is, the conductor-bonded portion 7 is formed by superimposing one or more flat-plate-shaped folded portions 27 on the flat-plate-shaped main body portion 25, and the anchor portions 37 are formed only in the folded portion 27.

A part of the conductor bond portion 17 enters the recess 41 and is in contact with the inner wall of the recess 41. A portion 43 of the conductor bond portion 17 having entered the recess 41 is formed of a part of the conductor 11 when the strands 15 of the conductor 11 of the cable 5 and the conductor-bonded portion 7 are put between the horn 19 and the anvil 21 to form the conductor bond portion 17 and to bond the conductor 11 of the cable 5 to the conductor-bonded portion 7.

Since the portion 43 of the conductor bond portion 17 has entered the recess 41 and the recess 41 is formed in the shape of a truncated cone or the like, even if the conductor bond portion 17 is attempted to be peeled from the conductor-bonded portion 7 of the terminal 3 in the terminal-bonded cable 1, the portion 43 of the conductor bond portion 17 having entered the recess 41 is caught by the recess 41 and is not easily peeled off.

As illustrated in FIG. 14, the portion 43 having entered the recess 41 of the conductor bond portion 17 may extend to the main body portion 25 or may stop in the middle. Further, the recess 41 may be formed by a hole penetrating the folded portion 27 and having a shape such as a truncated pyramid shape (for example, a quadrangular truncated pyramid shape).

In the fourth modification, each of the anchor portions 37 is formed of a through hole, but as in a fifth modification illustrated in FIGS. 15A to 15C and 16, a anchor portion 37 is formed in a shape of a dovetail groove or the like with folded portions 27. In the fifth modification illustrated in FIGS. 15A to 15C and 16, the configuration other than the anchor portion 37 is made similarly to the first modification illustrated in FIGS. 6A to 6C and 7.

More specifically, in the terminal 3 according to the fifth modification illustrated in FIGS. 15A to 15C and 16, the anchor portion 37 is formed by respective end faces (the obliquely formed end faces) 45 of a plurality (two for example) of folded portions 27.

Figure 15C:
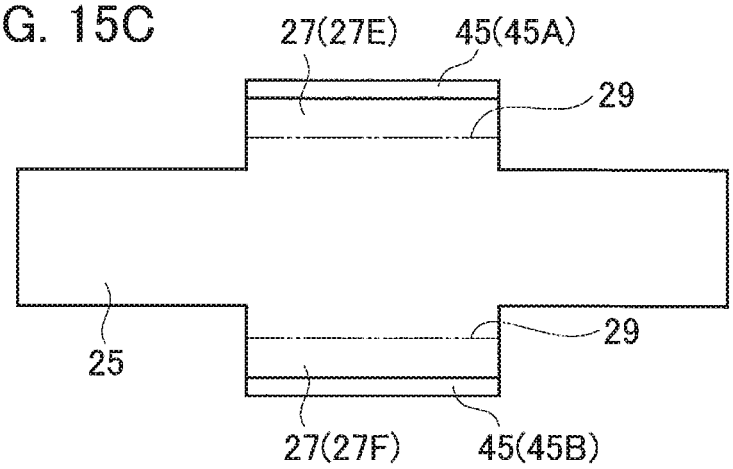
FIG. 15C is a development view of the terminal.
Figure 15B:
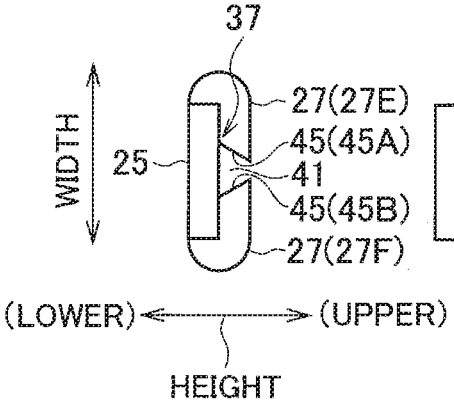
FIG. 15B is a side view of the terminal.

In this case, as illustrated in FIG. 15B, an end surface 45A of the first folded portion 27E is formed as an inclined surface and an end surface 45B of the second folded portion 27F is formed as an inclined surface, so that a dovetail-groove-shaped anchor portion 37 is formed between the end surface 45A and the end surface 45B. Instead of the dovetail groove-shaped anchor portion 37, an anchor portion 37 having another shape such as T-groove shape may be used.

Figure 17:
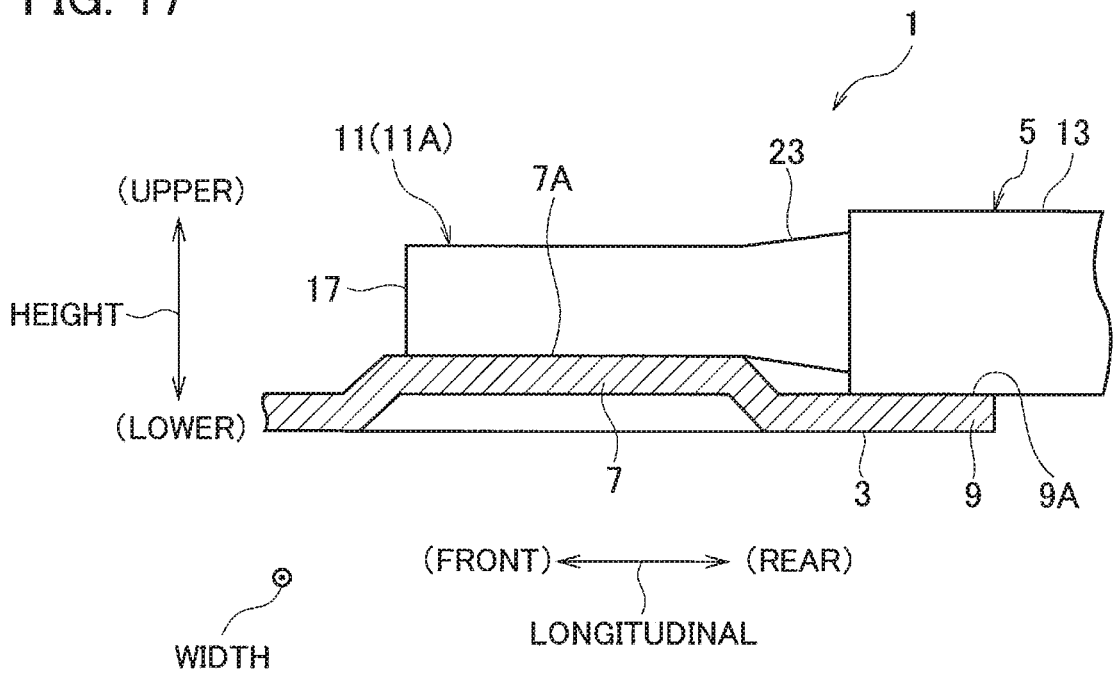
FIG. 17 is a diagram illustrating a terminal according to a sixth modification of the terminal-bonded cable according to the embodiment.

In the terminal 3 according to the first to third modifications illustrated in FIGS. 4A to 11, the conductor-bonded portion 7 of the terminal 3 is formed by appropriately bending a flat-plate-shaped material having a predetermined shape, but as in a case of a terminal 3 according to a sixth modification illustrated in FIG. 17, a conductor-bonded portion 7 of the terminal 3 may be formed by raising a part of a flat-plate-shaped material having a predetermined shape by plastic working.

In addition, the anchor portion 37 may be formed by providing a through hole having a truncated cone shape or the like in the conductor-bonded portion 7 of the terminal 3 according to the sixth modification illustrated in FIG. 17.

Next, a method of manufacturing the terminal-bonded cable 1 will be described by taking the embodiment illustrated in FIGS. 2, 4A to 4C, and 5 as an example.

First, as illustrated in FIG. 4C, a flat-plate-shaped material having a predetermined shape is prepared and this material is folded along the boundary 29 between the main body portion 25 and the folded portion 27 so that the conductor-bonded portion 7 and the sheath-contacted portion 9 are formed.

Subsequently, as illustrated in FIG. 2, the exposed conductor portion 11A of the conductor 11 of the cable 5 and the conductor-bonded portion 7 of the terminal 3 are put between the anvil 21 and the horn 19 at a predetermined pressure, and the horn 19 is ultrasonically vibrated for a fixed period of time.

As a result, the conductor bond portion 17 of the conductor 11 of the cable 5 is formed, and at the same time the conductor bond portion 17 is fixed to the conductor-bonded portion 7.

Subsequently, by separating the anvil 21 and the horn 19 from the conductor 11 of the cable 5 and the conductor-bonded portion 7 of the terminal 3, the terminal-bonded cable 1 as illustrated in FIG. 5 is obtained.

In the case where the anchor portions 37 (see FIGS. 12A to 14) formed by the recesses 41 are provided in the conductor-bonded portion 7 as in the fourth modification, the recesses 41 are formed in the material plate and then the plate is folded, for example.

According to the terminal-bonded cable 1, since the conductor-bonded portion 7 protrudes beyond the sheath-contacted portion 9, the amount of deformation of the strands 15 at the intermediate portion 23 is dispersed on the upper side and the lower side so as to be smaller, and cutting of the strands 15 constituting the conductor 11 is prevented. Then, the performance of the connected portion between the terminal 3 and the conductor 11 is stabilized.

Further, according to the terminal-bonded cable 1, when the anchor portions 37 are provided in the conductor-bonded portion 7 as in the fourth modification, since the conductor bond portion 17 is engaged with the anchor portions 37, the bonding force between the terminal 3 and the conductor bond portion 17 is increased so that the conductor bond portion 17 bonded to the terminal 3 is prevented from being peeled from the terminal 3.

Further, according to the terminal-bonded cable 1, since the folded portion 27 is folded back along the boundary 29 between the main body portion 25 and the folded portion 27 and overlaps the main body portion 25 so that the conductor-bonded portion 7 and the sheath-contacted portion 9 are formed, the conductor-bonded portion 7 and the sheath-contacted portion 9 are surely integrated with each other so that the rigidity of the terminal 3 is increased and the electric resistance of the terminal 3 itself is reduced.

Further, since the conductor-bonded portion 7 and the sheath-contacted portion 9 are formed by folding back the folded portion 27 with respect to the main body portion 25 along the boundary 29 between the main body portion 25 and the folded portion 27, the manufacturing process of the terminal 3 is simplified.

Further, according to the terminal-bonded cable 1, a trace caused by contacting with the horn 19 used in ultrasonic bonding is formed on the conductor bond portion 17, and a trace caused by contact with the anvil 21 used for ultrasonic bonding is formed on the back surface of the main body portion 25. That is, when the cable 5 is fixed on the terminal 3, since the conductor 11 of the cable 5 and the conductor-bonded portion 7 are put by the horn 19 and the anvil 21 and the horn 19 is ultrasonically vibrated, the manufacturing process of the terminal-bonded cable 1 has been simplified.

Further, according to the terminal-bonded cable 1, as in the fourth modification, in the case where the anchor portion 37 is formed by the recess 41 formed by being recessed from the anchor exclusion portion 39, by putting and pressing the terminal 3 and the conductor 11 between the anvil 21 and the horn 19, the portion 43 of the conductor bond portion 17 surely enters the anchor portion 37 and the function of the anchor portion 37 is certainly exerted.

That is, when a force for peeling the conductor bond portion 17 from the conductor-bonded portion 7 is applied, the portion 43 of the conductor bond portion 17 which has entered the anchor portion 37 is caught by the anchor portion 37 and the cable 5 is prevented from being peeled from the terminal 3 easily.

Further, according to the terminal-bonded cable 1 according to the fourth modification or the fifth modification illustrated in FIGS. 12A to 16, since the recess 41 is formed in a frustum shape or a dovetail groove shape, a part of the conductor bond portion 17 having entered the recess 41 forming the anchor portion 37 can be surely prevented from coming out of the recess 41 and the function of the anchor portion 37 can be exerted more certainly.

Further, according to the terminal-bonded cable 1 according to the fourth modification illustrated in FIGS. 12A to 14, since the anchor portion 37 is formed of the through hole 31 provided in the folded portion 27, a reduction in the rigidity of the conductor-bonded portion 7 can be suppressed though the anchor portion 37 is provided.

Further, according to the terminal-bonded cable 1 according to the fourth modification or the fifth modification illustrated in FIGS. 12A to 16, since the anchor portion 37 is formed only in the folded portion 27, a part of the conductor bond portion 17 having entered the anchor portion 37 when the conductor 11 of the cable 5 is fixed on the terminal 3 can be stopped by the main body portion 25, the volume of the portion 43 of the conductor bond portion 17 entering the anchor portion 37 can be made appropriate.

Figure 15A:
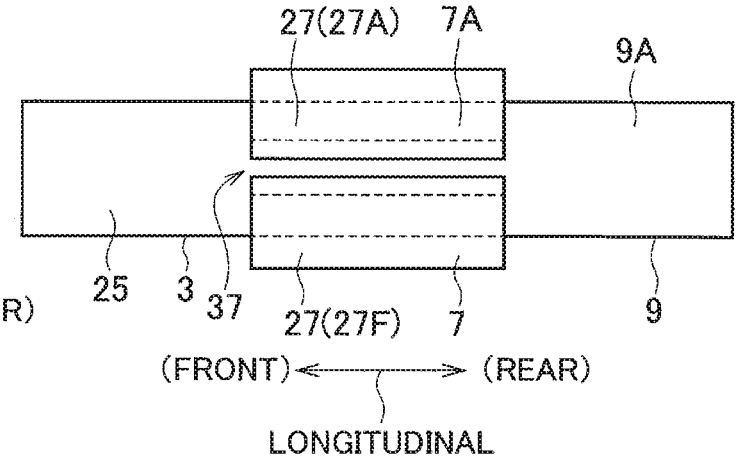
FIG. 15A is a front view illustrating a terminal according to a fifth modification of the terminal-bonded cable according to the embodiment.
Figure 16:
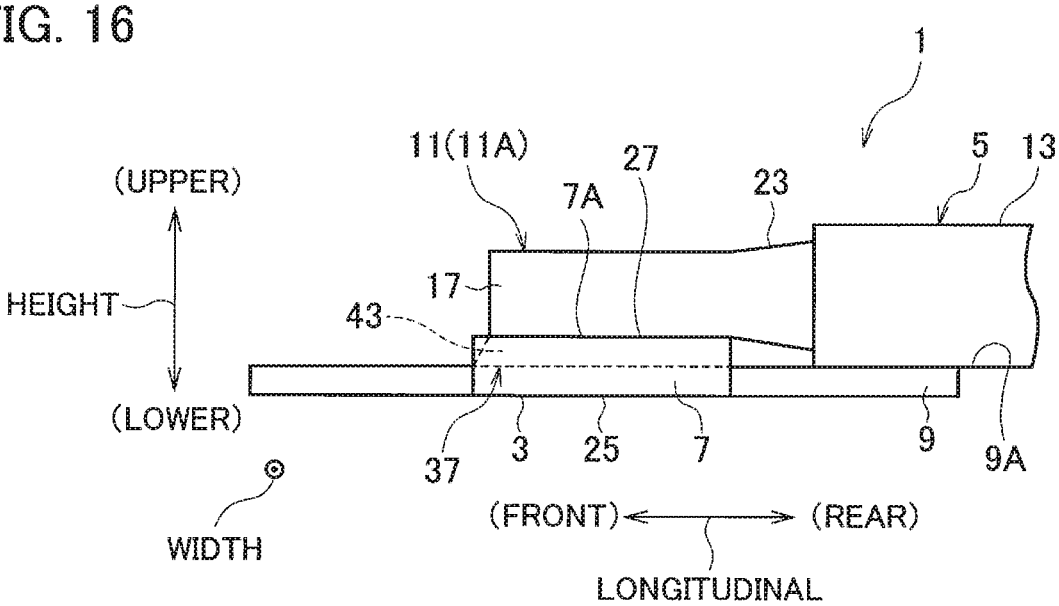
FIG. 16 is a diagram illustrating a terminal-bonded cable provided with the terminal according to the fifth modification illustrated in FIGS. 15A to 15C.

Further, according to the terminal-bonded cable 1 according to the fifth modification illustrated in FIGS. 15A to 16, the anchor portion 37 is formed by the respective end faces 45 of the plurality of folded portions 27, so that the anchor portion 37 can be formed large while the manufacturing process is simplified.

In the embodiment, the conductor-bonded portion 7 and the sheath-contacted portion 9 are formed by folding a flat-plate-shaped material having a predetermined shape along the boundary 29 between the main body portion 25 and the folded portion 27, but the main body portion 25 and the folded portion 27 may be separately formed and then the folded portion 27 may be integrally fixed to the main body portion 25 by brazing, welding, or the like to form the conductor-bonded portion 7 and the sheath-contacted portion 9.

Figure 18:
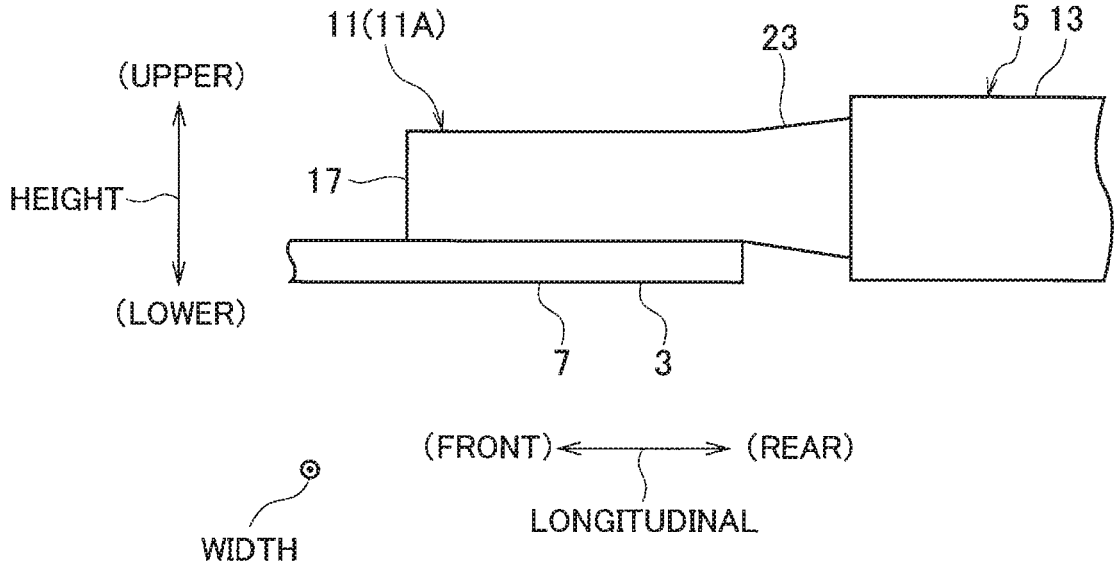
FIG. 18 is a diagram illustrating a terminal-bonded cable according to a reference example.
Figure 19:
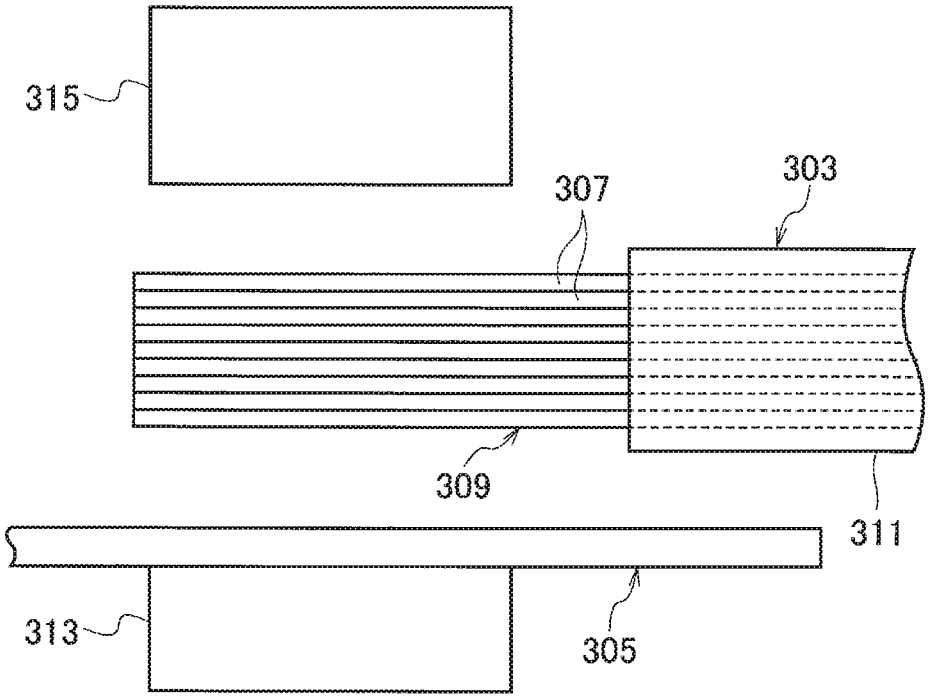
FIG. 19 PRIOR ART
FIG. 19 is a diagram illustrating a method of manufacturing a conventional terminal-bonded cable, and illustrating a state before forming a bond portion.
Figure 20:
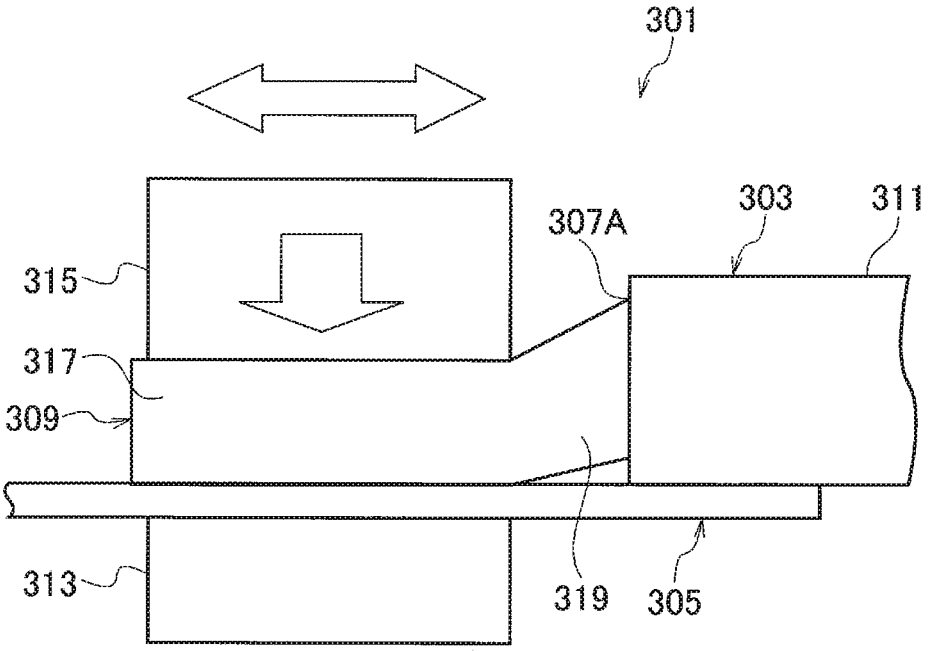
FIG. 20 PRIOR ART
FIG. 20 is a diagram illustrating the conventional terminal-bonded cable.

Incidentally, it is also conceivable to bond the conductor 11 of the cable 5 to the terminal 3 by forming the conductor-bonded portion 7 of the terminal 3 in a single flat-plate-shape like the terminal-bonded cable according to the reference example illustrated in FIG. 18 without providing the sheath-contacted portion 9.

Furthermore, in the embodiment, although the formation of the conductor bond portion 17 and the bonding of the conductor bond portion 17 to the conductor-bonded portion 7 are performed by ultrasonic bonding, the bonding may be performed by a process, other than ultrasonic bonding, such as cold welding, friction stir bonding, friction welding, electromagnetic welding, diffusion bonding, brazing, soldering, resistance welding, electron beam welding, laser welding, and light beam welding.

What is claimed is:

1. A terminal-bonded cable, comprising:

a terminal comprising a conductor-bonded portion having a substantially flat plate shape and a sheath-contacted position having a substantially flat plate shape; and a cable comprising a conductor constituted by a plurality of strands, a sheath which covers the conductor, an exposed conductor portion in which the conductor is partially exposed from the sheath in a length direction, and a bond portion which is formed in a part of the exposed conductor portion and in which the strands are bonded to each other, the bond portion formed into a substantially rectangular parallelepiped shape wherein a first surface of the bond portion is surface bonded to a flat surface of the conductor-bonded portion, the sheath is in contact with the sheath-contacted portion, and the conductor-bonded portion protrudes from a surface of the sheath-contacted portion in a thickness direction of the sheath-contacted portion.

2. The terminal-bonded cable according to claim 1, wherein the conductor-bonded portion and the sheath-contacted portion are constituted by a flat-plate-shaped main body portion and a flat-plate-shaped folded portion, the folded portion is folded back with respect to the main body portion along a boundary between the main body portion and the folded portion so that the folded portion overlaps a part of the main body portion, the conductor-bonded portion is formed in a position where the main body portion and the folded portion overlap each other, the sheath-contacted portion is formed only in a position on the main body portion where the folded portion does not overlap the main body portion, the first surface of the bond portion is surface bonded to a surface of the folded portion, and the sheath is in contact with a surface of the main body portion.

3. The terminal-bonded cable according to claim 1, wherein the first surface of the bond portion and the flat surface of conductor-bonded portion are surface bonded by ultrasonic bonding, and a trace caused by contact with a horn used in the ultrasonic bonding or a trace caused by contact with an anvil used in the ultrasonic bonding is formed on a second surface opposed to the first surface of the bond portion.

4. The terminal-bonded cable according to claim 1, wherein an anchor portion is provided in the conductor-bonded portion, and the bond portion is engaged with the anchor portion.

5. The terminal-bonded cable according to claim 4, wherein the anchor portion includes a recess formed by being recessed from an anchor exclusion portion which is a portion of the conductor-bonded portion excluding the anchor portion, and an inner diameter of at least a part of the recess increases with distance from the anchor exclusion portion.

* * * * *